US005088306A

United States Patent [19]

Field

[11] Patent Number: 5,088,306

[45] Date of Patent: Feb. 18, 1992

[54] CYLINDER LOCK WITH CHANGEABLE KEYWAY

[75] Inventor: Peter H. Field, Salem, Va.

[73] Assignee: Medeco Security Locks, Inc., Salem, Va.

[21] Appl. No.: 429,634

[22] Filed: Oct. 31, 1989

[51] Int. Cl.[5] ..... E05B 15/06

[52] U.S. Cl. ..... 70/375; 29/401.1; 29/402.08; 70/382; 70/385; 70/420; 70/453

[58] Field of Search ..... 70/385, 420, 374, 375, 70/372, 346, 347, 453, 454, 400, 356, DIG. 44, 382; 29/401.1, 402.08

[56] References Cited

U.S. PATENT DOCUMENTS

| | | | |
|---|---|---|---|
| 9,787 | 7/1881 | Schade | 70/453 X |
| Re. 20,143 | 10/1936 | Gray | 70/46 |
| 234,213 | 11/1880 | Taylor | 70/453 |
| 234,630 | 11/1880 | Towne | 70/375 |
| 437,939 | 10/1890 | Sargent | 70/453 |
| 446,176 | 2/1891 | Shaw | 70/453 |
| 567,305 | 9/1896 | Donovan . | |
| 608,069 | 7/1898 | Noack . | |
| 1,422,520 | 7/1922 | Augenbraun | 70/375 |
| 1,565,558 | 12/1925 | Fremon | 70/375 |
| 1,937,224 | 11/1933 | Gray | 70/46 |
| 2,721,470 | 10/1955 | Hensel | 70/453 |
| 2,790,318 | 4/1957 | Jannette | 70/364 |
| 3,287,945 | 11/1966 | Yulkowski | 70/364 |
| 3,429,154 | 2/1969 | Schwartz | 70/375 |
| 3,492,842 | 2/1970 | Schlage | 70/385 |
| 3,499,304 | 3/1970 | Naujoks | 70/406 |
| 3,597,948 | 8/1971 | Johnstone | 79/364 |
| 3,702,553 | 11/1972 | Nolin | 70/375 |
| 3,736,780 | 6/1973 | Singer | 70/382 X |
| 3,824,818 | 7/1974 | Neale | 70/358 |
| 4,103,525 | 8/1978 | Kamiya | 70/345 |
| 4,127,996 | 12/1978 | Malminen et al. | 70/365 |
| 4,168,617 | 9/1979 | Prunbauer | 70/406 |
| 4,231,242 | 11/1980 | Hill et al. | 70/385 X |
| 4,320,638 | 3/1982 | Dunphy et al. | 70/358 |
| 4,416,128 | 11/1983 | Steinbrink | 70/364 |
| 4,446,709 | 5/1984 | Steinbach | 70/363 |
| 4,472,953 | 9/1984 | Gater | 70/373 |
| 4,478,061 | 10/1984 | Preddey | 70/358 |
| 4,539,829 | 9/1985 | Givol | 70/385 X |
| 4,653,298 | 3/1987 | Tietz | 70/406 |

FOREIGN PATENT DOCUMENTS

| | | | |
|---|---|---|---|
| 187645 | 8/1937 | Switzerland | 70/375 |

*Primary Examiner*—Lloyd A. Gall
*Attorney, Agent, or Firm*—Rothwell, Figg, Ernst & Kurz

[57] ABSTRACT

A cylinder lock is capable of providing a changeable keyway by means of elongated warding members which are insertable into a keyway access slot which has a cross-sectional configuration larger than for a desired key. There may be one or more warding members which are insertable into the plug and extend the length of the keyway access lot to define the cross-sectional area of a desired key.

13 Claims, 6 Drawing Sheets

1/6

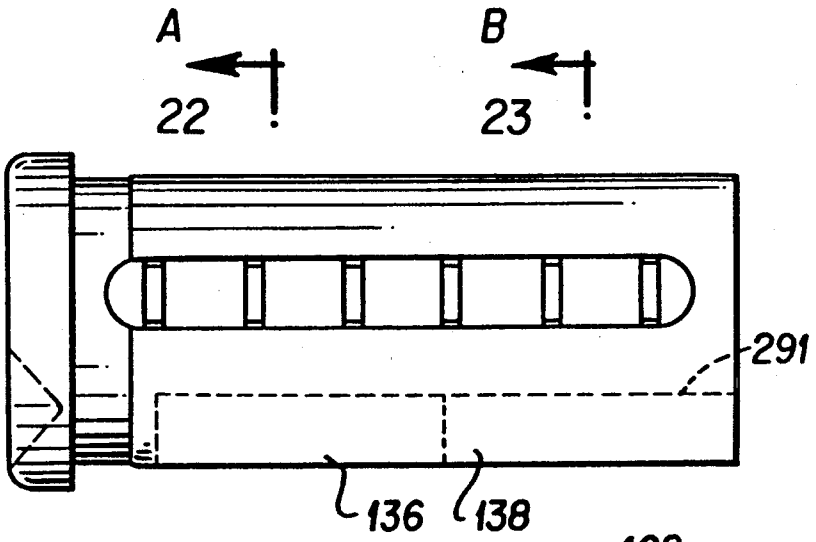
FIG. 19
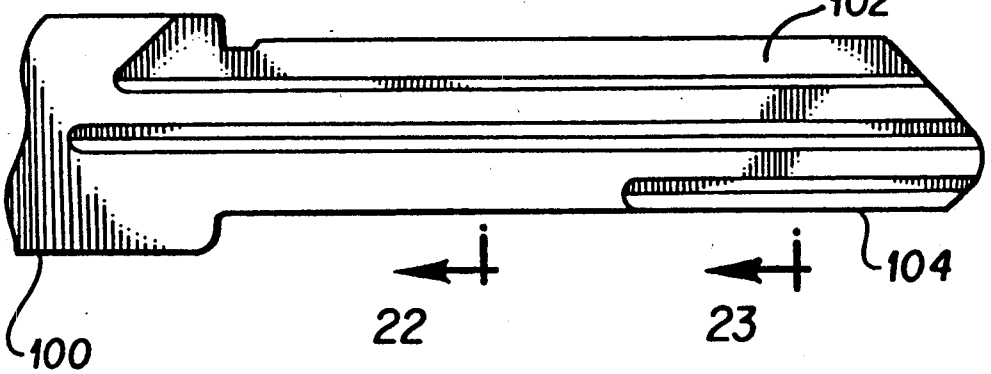
FIG. 20
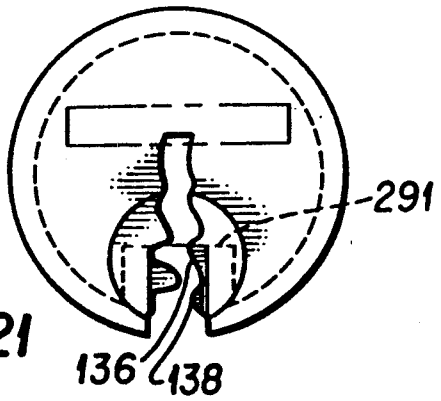
FIG. 21
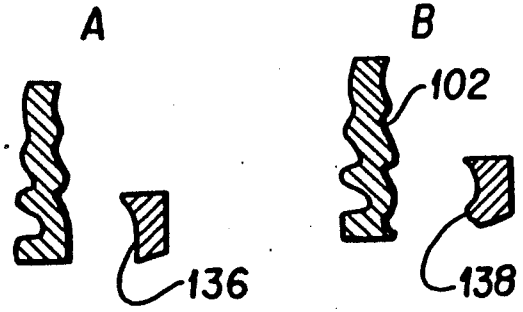
FIG. 22
FIG. 23

CYLINDER LOCK WITH CHANGEABLE KEYWAY

FIELD OF THE INVENTION

This invention relates to improvements in the field of cylinder locks and particularly to a cylinder lock having a plug capable of providing multiple different keyways.

BACKGROUND AND PRIOR ART

Cylinder locks are well known in the art and typically include a cylinder plug rotatable within the bore of a shell, the plug having a longitudinal access opening therein for a key, and some form of mechanical stop means cooperating with the shell and plug preventing rotation of the plug unless a properly configured key is utilized to operate the mechanical stop means. Typically, the mechanical stop means would include tumblers which clear a shear line upon being raised by a properly bitted key. In addition to being properly bitted, a key must have a key blade cross section which fits into a keyway in the cylinder plug.

Quite often, for a number of different purposes, it is highly desirable to be able to quickly change the cross-sectional area of the keyway which, of course, determines the cross sectional area of the key blade and the blade of the keyblank. For example, in master keying a configuration can be devised where a master key could fit into all keyways of a system, but only certain individual keys could operate with certain keyways.

Additionally, in connection with a locksmith stocking locks having particular keyways and in production of locks having particular keyways, flexibility in providing keyways on demand would be highly desirable but at present is not known or available.

In the area of key control, particular keyways could be devised which could be limited to particular users or customers for locks.

Commonly, control procedures are utilized to the extent possible to prevent unauthorized duplication of keys. Medeco Security Locks, Inc. of Salem, Va., for example, provides key control by manufacturing cylinders which use keys that must be made on special key cutting machines, selling only to professional security industries, and pursuing unauthorized manufacture and distribution of restricted keyblanks.

There is a need in the art for providing key control with easily exchanged restrictive keyway sections, by providing a multiplicity of keyway configuration possibilities. If multiple keyway possibilities may be obtained by simple change in a lock, similar to having a removable plug, then security against unauthorized key duplication can be increased. Moreover, as noted above, a changeable keyway lock would also provide for expanded possibilities of master key systems, reduce locksmith stocking requirements and simplify production requirements.

Master key pinlocks are known in which the key has selective portions cut away, see Donovan U.S. Pat. No. 567,305.

There are also teachings in the prior art of utilizing a thin section within a cylinder lock to define a keyway, such section being removable, see for example Gray Re. U.S. Pat. No. 20,143. However, such inserts are perpendicular to key access and define the keyway only at a limited point or points. Similar teachings are found in Taylor U.S. Pat. No. 234,213 (slotted disks define keyway); Jannette U.S. Pat. No. 2,790,318 (accordion folded member defines keyway); Singer U.S. Pat. No. 3,736,780 (face of plug defines configuration for key access); Malminen et al. U.S. Pat. No. 4,127,996 (insert disks define keyway at limited points); Hill et al. U.S. Pat. No. 4,231,242 (pins project in the key slot for limited contact points); Steinbach U.S. Pat. No. 4,446,709 (plate inserted at the face of the cylinder plug); and Preddey U.S. Pat. No. 4,478,061 (removable piece fitted at front of plug).

It is also known in the prior art to construct a cylinder lock plug of separate half cylindrical elements which fit together and define a keyway, see e.g. Schwartz U.S. Pat. No. 3,429,154, Nolin U.S. Pat. No. 3,702,553, and Gater U.S. Pat. No. 4,472,953.

It is further known in the art to provide an insert requiring a notch in the bottom of a key to define a keyway, see for example Yulkowski U.S. Pat. No. 3,287,945 and Neale U.S. Pat. No. 3,824,818.

Johnstone, in U.S. Pat. No. 3,597,948, shows a keyway with a additional groove in the end of the key to increase the number of lock combinations, but the keyway is not changeable.

Even in the well worked prior art of cylinder locks, there remains a need in the art for a simple and effective construction to allow a cylinder lock plug to accommodate different key sections by providing a changeable keyway which extends the length of the plug and as a consequence also provides enhanced master keying possibilities.

SUMMARY OF THE INVENTION

In this invention, a plug for a cylinder lock of any known conventional type has at least a portion of its keyway defined by an elongated slidable, insertable warding member or members. The warding member(s) define the configuration of the keyway along extensive areas along the sides of the key and may be insertably positioned along one or both sides of the key or as a single piece on both sides of the key.

BRIEF DESCRIPTION OF THE DRAWINGS

FIG. 19 is a side elevation view of a further embodiment.

FIG. 20 is a side elevation view of a unique key for use in the FIG. 19 embodiment.

FIG. 21 is a front elevation view of the FIG. 19 embodiment.

FIG. 22 is a sectional view taken along line 22—22 of FIGS. 19 and 20 showing a portion of the keyway insert from FIG. 19 and the key blade of FIG. 20.

FIG. 23 is a sectional view taken on line 23—23 through FIGS. 19 and 20 showing a different section of the key and a different configured keyway insert.

DETAILED DESCRIPTION OF THE PREFERRED EMBODIMENTS

Figure 1:
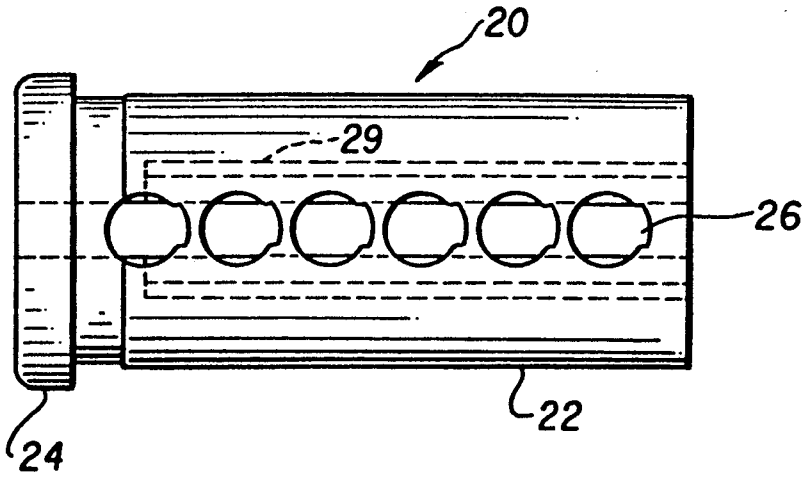
FIG. 1 is a top plan view of the cylinder lock having the changeable keyway of this invention.
Figure 2:
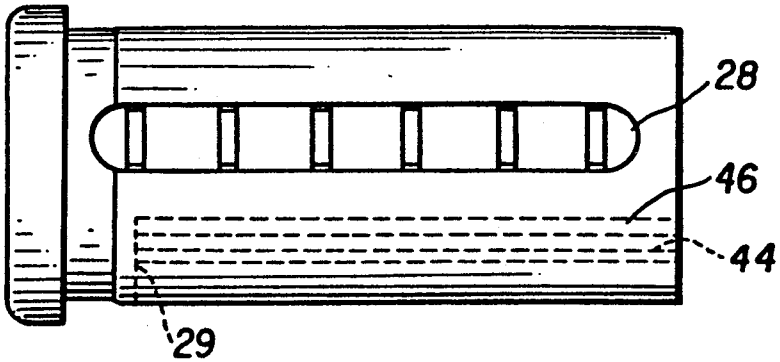
FIG. 2 is a side elevation view of the cylinder lock of FIG. 1.

As shown in FIG. 1, the rotatable plug 20 of a conventional type lock cylinder has a cylindrical body 22 and an enlarged head 24. The cylinder lock may be inserted in a door lock, a padlock, or other places that cylinder locks are conventionally used. The rotatable plug 20 has a plurality of tumbler holes 26 for receipt of tumbler pins (not shown) as is conventional in the art. The tumblers or similar mechanical stop means prevent the plug from rotating unless a properly bitted key moves the tumblers to clear a shear line between the plug and the cylinder body as is well known in the art. In some cases, particularly for the MEDECO® type lock, the cylinder lock may also have a side bar slot 28 for a slide bar or fence as is known in the art.

Figure 3:
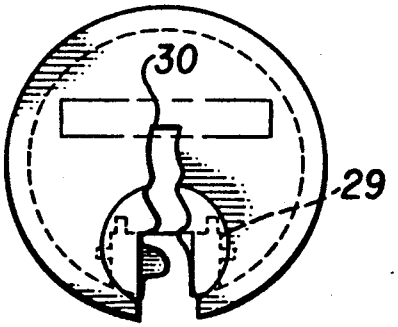
FIG. 3 is a front end elevation view of the lock of FIG. 1.
Figure 4:
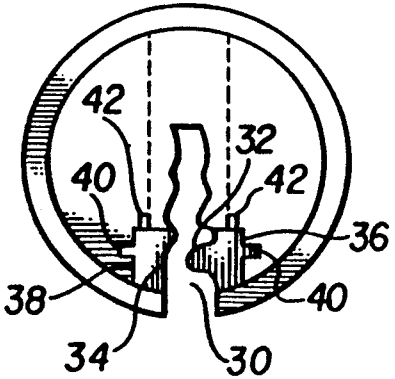
FIG. 4 is a rear end elevation view of the lock of FIG. 1.

As shown in FIG. 3, the plug 20 has a longitudinal face opening 29, at least the top portion of which defines a keyway 30. The keyway has the same cross-sectional area as a proper key. Typically, lock manufacturers, particularly those desiring key control, attempt to provide a keyway that is unique, i.e., that does not have the same in cross-sectional area of any other keyway so that keys made from another manufacturer's keyblanks will not work to operate the lock. The configuration of the keyway, of course, determines the cross-sectional configuration of the blade of the keyblank and certain security operations, for example a large installation customer, may require a completely unique keyway.

In the FIGS. 1-4 embodiment, the lower portion of the keyway is defined by the inner surfaces 32 and 34 of a pair of elongated warding members, 36 and 38. Warding members 36 and 38 are also keyway defining inserts and have on them projections 40 and 42 for cooperating with milled slots 44 and 46 in plug 20. That is, without the members 36 and 38, the longitudinal access opening 29 is larger than the keyway 30.

Standard metalworking techniques are used for keying the inserts to the plug and the details have been left off the other embodiments for the sake of clarity. The inserts can also be held in place with pins, screws, clip rings and other known techniques. The important feature is that the inserts are changeable, elongated, extend substantially the length of the keyblade, and define at least the lower portion of the keyway.

Figure 6:
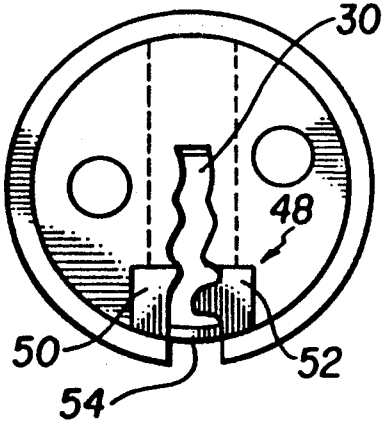
FIG. 6 is a rear end elevation view of the FIG. 5 embodiment.
Figure 5A:
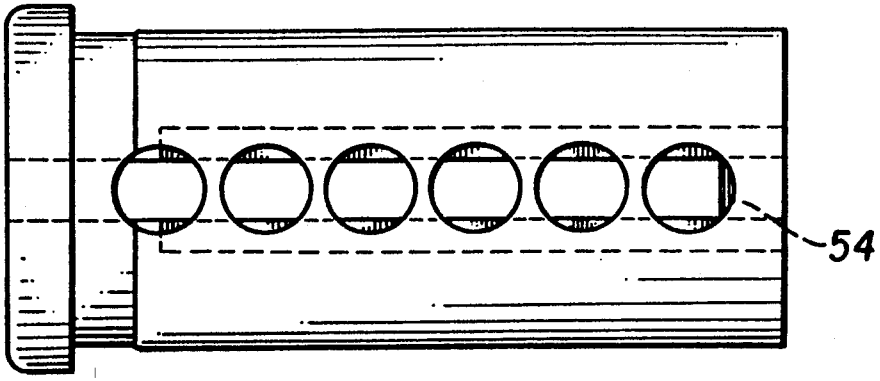
FIG. 5A is a top plan view of the FIG. 5 embodiment.
Figure 5:
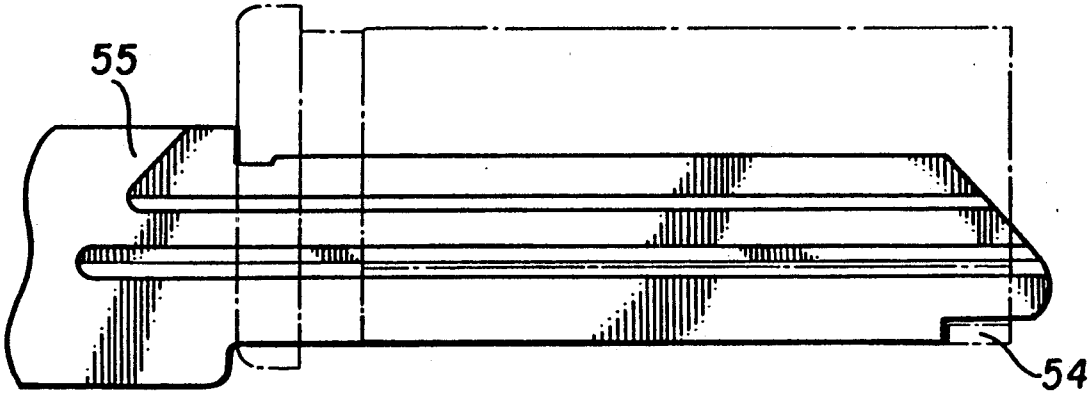
FIG. 5 is a side elevation view of a cylinder lock having a changeable keyway of another embodiment.

FIGS. 5, 5A, and 6 illustrate a further embodiment in which there is a single warding member or keyway defining insert 48 having two side portions, 50 and 52 which are configured to define the lower portion of the keyway 30. A joining member, 54, joins the two sections 50 and 52 across the back bottom of the keyway and operates with a key 55 formed from a keyblank (as shown) but having bits cut in the top edge of the blade of the keyblank as is conventional and well known in the art and shaped so as not to be obstructed by member 54.

Figure 7:
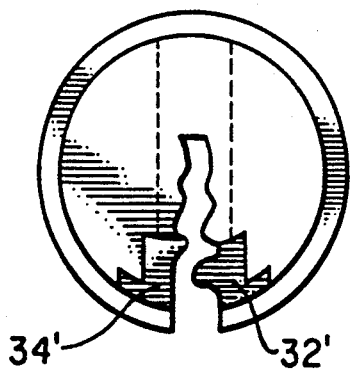
FIG. 7 is an end elevation view of a further embodiment of the interchangeable inserts.

FIG. 7 shows a further embodiment with a different configuration for keying the warding members 32' and 34'.

Figure 8:
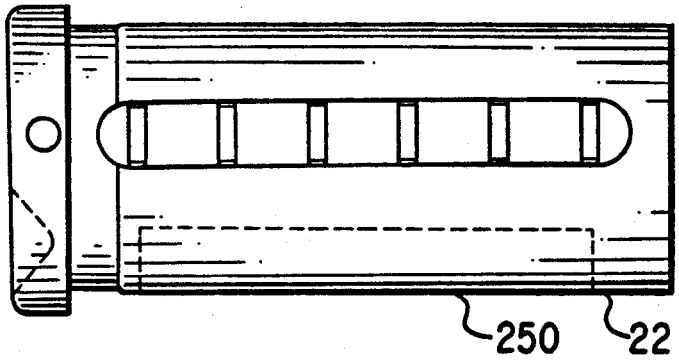
FIG. 8 is a side elevation view of another embodiment with the changeable inserts inserted from the bottom.
Figure 9:
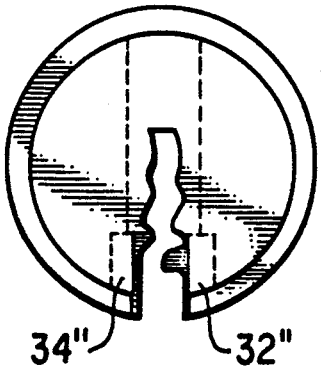
FIG. 9 is a rear end elevation view of the FIG. 8 embodiment.

FIGS. 8 and 9 illustrate yet another embodiment in which there are two elongated inserts or warding members 32" and 34" which are inserted from the bottom of the plug through an opening 250 which does not extend the length of the plug body.

Figure 10:
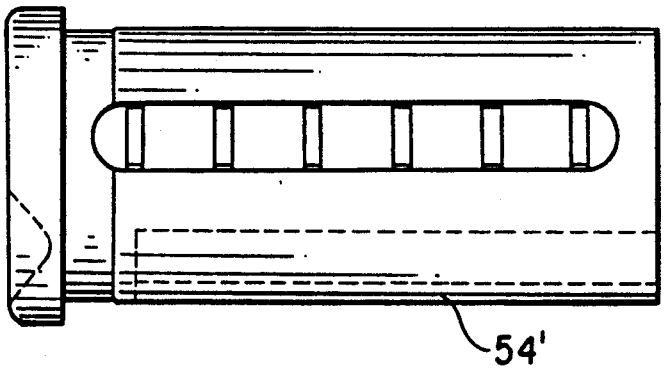
FIG. 10 is a side elevation view of a further embodiment in which the keyway is single piece.

The FIG. 10 embodiment is similar to the FIG. 6 embodiment except that the connecting member 54' extends the length of the insert and encloses the bottom of the keyway to support the key during operation.

Figure 11:
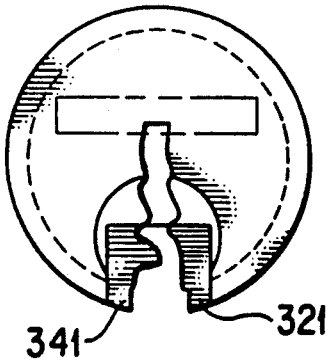
FIG. 11 is a front elevation view of a further embodiment.
Figure 12:
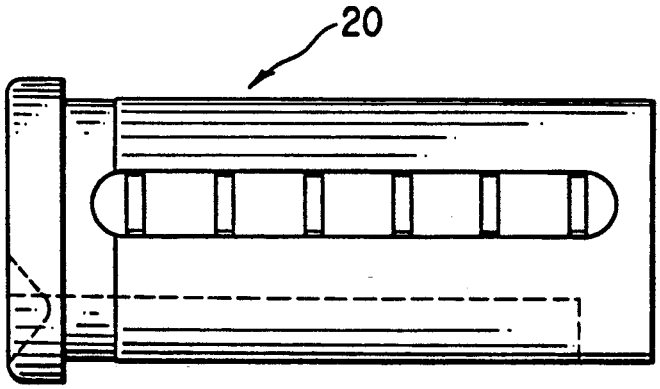
FIG. 12 is a side elevation view of the FIG. 11 embodiment.

FIGS. 11 and 12 illustrate a further embodiment in which two elongated warding members or inserts, 321 and 341, are slidably inserted from the front of the plug.

Figure 13:
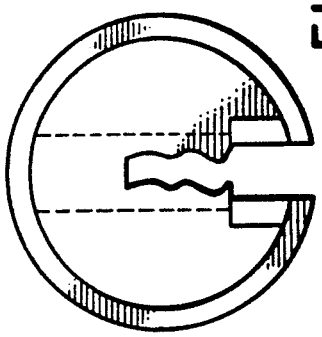
FIG. 13 is an end elevation view without an insert.

FIGS. 13-18 illustrate further embodiments and variations in rear end views. In FIG. 13 there are no inserts or warding members, and the bottom portion of the longitudinal access opening does not define a keyway until inserts are installed.

Figure 14:
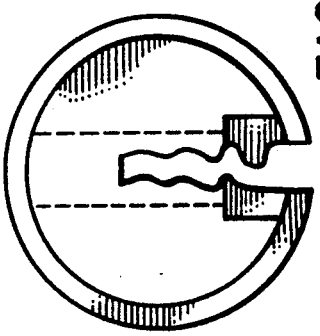
FIGS. 14, 15, and 16 are end elevation views each with two different inserts, showing different keyways obtained.
Figure 15:
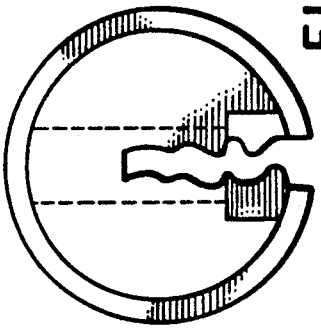
Figure 16:
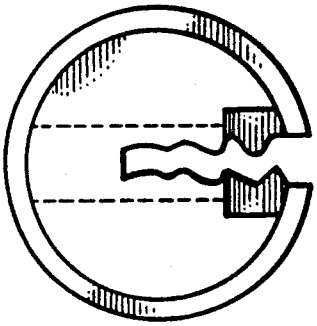
Figure 17:
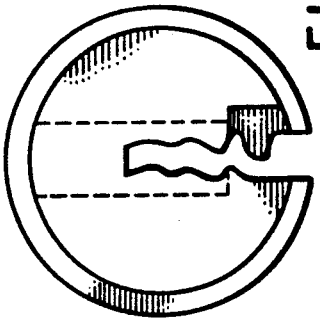
FIG. 17 is an end elevation view with one insert.
Figure 18:
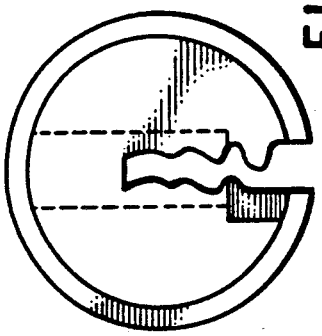
FIG. 18 is an end elevation view with one insert.

FIGS. 14, 15, and 16 illustrate different configurations of keyway defining inserts or warding members showing different keyway configurations that can be achieved with the same plug and cylinder. FIGS. 17 and 18 are illustrate embodiments using a single warding member or keyway defining insert which is inserted on one side or the other of the keyway.

The embodiment shown in FIGS. 19-23 includes a cylinder lock body of conventional type as described before in which the plug has an elongated enlarged access opening 291 for insertion of separately configured elongated warding members or keyway defining members 136 and 138. As shown in FIG. 19, the members 136 and 138 are slidably insertable from the rear of the plug and are assembled end to end so that the keyway defined has a different cross-sectional area at different longitudinal portions of the keyway. This embodiment allows the use of a uniquely configured keyblank 100 in which the keyblade has a configuration 102 at the top portion thereof which is constant throughout the length of the blade while the bottom portion of the blade has an additional groove 104 to allow it to fit within the portion of the keyway defined by keyway insert 138.

As can be seen, this invention provides a unique arrangement for defining keyways with elongated longitudinal inserts extending along the surface of a keyblade. With this invention, a key manufacturer desiring to provide unique keyways can significantly reduce the cost of manufacturing and the cost of inventory while users of such locks can have uniquely defined keyways which can be changed substantially at will giving the opportunity to provide high security key control.

I claim:

1. A plug for a cylinder lock for providing desired selected keyway configurations independently of the cross-sectional shape of a longitudinal key access slot through the plug, comprising:

(a) a cylinder plug body rotatable in a shell when tumblers clear a shear line;

(b) a longitudinal keyway access slot in the cylinder plug body extending to a front face thereof, the cross-sectional area of the access slot, in its lower part, being larger than the desired cross-sectional area of a property shaped key blade and, in its upper part, conforming to the cross-sectional shape of an upper part of the keyblade;

(c) groove means in the plug body extending along at least one side of the lower part of the keyway access slot;

(d) removable and replaceable elongated warding member means, slidable in the groove means, including two elongated warding members, one of each side of the keyway access slot, the elongated warding member means having a portion which extends into the cross-sectional area of the lower part of the access slot to limit and define said area to provide a desired keyway configuration for a portion of a configured side surface of a flat keyblade with edge bits so that by providing a selected configuration warding member means a desired selected keyway can be defined and provided, and wherein each warding member is connected to the other at a bottom of the keyway access slot.

2. A cylinder lock with a changeable keyway, the cylinder lock being of the type having a shell with a longitudinal bore, a plug rotatable within the bore of the shell, the plug having a longitudinal access opening therein for a thin flat key having a blade with a configured side surface and an edge having bits therein, and mechanical stop tumbler means cooperating with the shell and the plug for preventing rotation of the plug unless a properly configured key blade having properly cut bits on the edge of its blade operates the mechanical stop tumbler means, the lock having improvements which provide a changeable keyway, the improvements comprising: the longitudinal access opening in the plug having a cross section which is at least in part larger than the cross sectional area of the properly configured key blade, and an elongated interchangeable insert member means having a configuration along at least one side of the elongated portion thereof which conforms to the configuration of only a portion of the side surfaces of the key blade, said portion of the side surfaces including a section with either a groove or a rib and another section void of said groove or rib, the interchangeable insert member means being interchangeably attachable to the plug in the area of the longitudinal access opening in the plug and extending therealong to diminish the cross-sectional area of said access opening and conform such cross-sectional area of said access opening to the desired cross-sectional keyway area of the keyblade.

3. A key configured to fit within a keyway of the cylinder lock of claim 2.

4. A keyblank for configuring the key of claim 3.

5. A lock as defined in claim 2 wherein the interchangeable insert member means is at least one elongated warding member attachable to the plug.

6. A lock as in claim 5 where there are two warding members attachable to the plug, one on each side of the access opening in the plug.

7. A lock as defined in claim 2 wherein the insert member means is slidable into a longitudinal groove in the plug adjacent the access opening.

8. A lock as defined in claim 7 wherein the insert member means is longitudinally slidable from a rear end of the lock.

9. A lock as defined in claim 7 wherein the insert member means is longitudinally slidable from a front end of the lock.

10. A lock as defined in claim 7 wherein the insert member means is insertable from a bottom of the lock.

11. A cylinder lock with a changeable keyway, the cylinder lock being of the type having a shell with a longitudinal bore, a plug rotatable within the bore of the shell, the plug having a longitudinal access opening therein for a key, and mechanical stop means cooperating with the shell and plug for preventing rotation of the plug unless a properly configured key operates the mechanical stop means, the lock having improvements to provide a changeable keyway comprising:

the longitudinal access opening in the plug having a cross-sectional area which, in a portion thereof, conforms to a portion of a thin flat blade of a key with the sides of the blade being configured and one edge of the blade having bits, said cross-sectional area of the longitudinal access opening, in another portion thereof, defining longitudinal insert receiving groove means; and said lock including at least two elongated keyway defining insert members easily removable and insertable into the insert receiving groove means of the longitudinal access opening and assembled end to end in the plug and extending along the longitudinal access opening to diminish the cross-sectional area of the access opening according to the configuration of each keyway defining insert member and to provide two successive longitudinal separate cross-sectional areas of the access opening of predetermined configurations which correspond to two desired longitudinally spaced cross-sections conforming to respective portions of the configured side surfaces of the blade.

12. A key configured to fit within a keyway of the lock of claim 11.

13. A keyblank for configuring the key of claim 12.

* * * * *